US010941641B2

(12) United States Patent
Huang et al.

(10) Patent No.: US 10,941,641 B2
(45) Date of Patent: Mar. 9, 2021

(54) LONG-DISTANCE DRILLING AND HYDROFRACTURING INTEGRATED DEVICE AND METHOD IN UNDERGROUND MINE

(71) Applicant: China University of Mining and Technology, Jiangsu (CN)

(72) Inventors: Bingxiang Huang, Jiangsu (CN); Haoze Li, Jiangsu (CN); Shuliang Chen, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/619,926

(22) PCT Filed: May 11, 2018

(86) PCT No.: PCT/CN2018/086474
§ 371 (c)(1),
(2) Date: Dec. 5, 2019

(87) PCT Pub. No.: WO2019/169734
PCT Pub. Date: Sep. 12, 2019

(65) Prior Publication Data

US 2020/0208504 A1 Jul. 2, 2020

(30) Foreign Application Priority Data

Mar. 9, 2018 (CN) ..... 201810194257.3

(51) Int. Cl.
*E21B 7/18* (2006.01)
*E21B 43/26* (2006.01)
(Continued)

(52) U.S. Cl.
CPC ..... *E21B 43/26* (2013.01); *E21B 7/18* (2013.01); *E21B 33/13* (2013.01); *E21B 34/14* (2013.01); *E21B 43/17* (2013.01)

(58) Field of Classification Search
CPC ..... E21B 7/18; E21B 43/26
See application file for complete search history.

(56) References Cited

U.S. PATENT DOCUMENTS

| | | | | |
|---|---|---|---|---|
| 6,041,855 | A | 3/2000 | Nistor | |
| 10,094,172 | B2 * | 10/2018 | Wang | E21B 43/26 |
| 2017/0175487 | A1 | 6/2017 | Marcin et al. | |

FOREIGN PATENT DOCUMENTS

| | | |
|---|---|---|
| CN | 101952545 | 1/2011 |
| CN | 104895484 | 9/2015 |
| CN | 105525900 | 4/2016 |

OTHER PUBLICATIONS

"International Search Report (Form PCT/ISA/210) of PCT/CN2018/086474," dated Nov. 22, 2018, with English translation thereof, pp. 1-4.

* cited by examiner

*Primary Examiner* — Matthew R Buck
(74) *Attorney, Agent, or Firm* — JCIPRNET

(57) ABSTRACT

A long-distance drilling and hydrofracturing integrated device and method in underground mine are provided. The device includes a drill bit, a hydrofracturing rod, an anti-impact rod, a hole sealing rod, a high-pressure sealed drill rod and a crawler drill rod feeder sequentially connected end to end. In the method, the drill rod and the hydrofracturing rod are delivered to a designated position while drilling, the drill rod does not need to be taken out, only a crawler drill needs to be improved, high-pressure water holes are added to the rod feeder, and the high-pressure water enters the drill rod from the high-pressure water holes and reaches the
(Continued)

hydrofracturing portion. When the hydrofracturing is completed, the drill rod is withdrawn by the crawler drill, reaches another hydrofracturing point, and a hole sealing operation can also be performed.

12 Claims, 5 Drawing Sheets

(51) Int. Cl.

| | |
|---|---|
| *E21B 33/13* | (2006.01) |
| *E21B 34/14* | (2006.01) |
| *E21B 43/17* | (2006.01) |

I - I

II - II

I - I

LONG-DISTANCE DRILLING AND HYDROFRACTURING INTEGRATED DEVICE AND METHOD IN UNDERGROUND MINE

CROSS-REFERENCE TO RELATED APPLICATION

This application is a 371 of international application of PCT application serial no. PCT/CN2018/086474, filed on May 11, 2018, which claims the priority benefit of China application no. 201810194257.3, filed on Mar. 9, 2018. The entirety of each of the above mentioned patent applications is hereby incorporated by reference herein and made a part of this specification.

BACKGROUND

Technical Field

The present invention relates to a long-distance drilling and hydrofracturing integrated device and method in underground mine, belonging to the field of mining engineering.

Description of Related Art

At present, hydraulic fracturing technology has been developed for many years, and has been widely applied in ground application. However, due to the limitation of construction environment in underground mine, the hydraulic fracturing technology is mechanized in a low level, many operations are completed by manpower and limited by manpower, and some large-angle and long-distance hydrofracturing operations cannot be done.

Furthermore, the underground mine hydraulic fracturing technology in known technologies requires drilling first, then withdrawing a drill rod, feeding a hole sealer into a designated position through a special mounting rod, and finally hydrofracturing. This technology requires rod withdrawal and hole sealer installation, and this process involves one entry and one exit, which not only increases the process, but also increases the labor intensity of workers. In particular, when the high-pressure sealed drill rod is installed, the manpower is still used, with long working time, low efficiency, and slow project progress. In addition, due to the limitation of the construction space, too many construction workers are not allowed. When some long-distance and large-angle installations of drill rods are performed, manpower is not feasible. Therefore, a proper device and solution are urgently needed.

Mine crawler drills have been widely applied to drilling in underground mine due to fast drilling speed, short time consumption and high efficiency, can realize automatic rod feeding with a small operating space, are highly mechanized, need a few workers, and are widely used in hydraulic fracturing drilling. A drill rod needs to be withdrawn after a crawler drill drills holes, while the hydraulic fracturing technology requires feeding a hole sealer into a designated work site with a special mounting rod after the drill rod is withdrawn, and such operation of one entry and one exit takes a lot of time and is low in efficiency.

At present, the hydraulic fracturing integrated technology in underground mine integrating a crawler drill with hydraulic fracturing has not appeared, and the technology needs to consider the problems of wear of a hole sealer due to the rotation of a drill rod, tightness of an ordinary drill rod through high-pressure water, etc. This technology also requires improvements on the ordinary drill rod to ensure the tightness of the ordinary drill rod in the presence of high-pressure water.

SUMMARY

To overcome the deficiencies of the prior art, the present invention provides a long-distance drilling and hydrofracturing integrated device and method in underground mine, which can improve the mechanization level and working efficiency of underground mine hydraulic fracturing, reduce workers, and can complete long-distance and large-angle drilling and hydrofracturing.

The technical solution adopted by the present invention to solve the technical problems is as follows A long-distance drilling and hydrofracturing integrated device in underground mine includes a drill bit, a hydrofracturing rod, an anti-impact rod, a hole sealing rod, a high-pressure sealed drill rod and a crawler drill rod feeder sequentially connected end to end. The hydrofracturing rod is hollow. A pressure control hydrofracturing device is installed at an inner middle position of the hydrofracturing rod, and the pressure control hydrofracturing device consists of a dust-proof pressure control component, a pressure control steel ball and a pressure control spring. The pressure control steel ball is installed in the dust-proof pressure control component. One end of the pressure control spring is connected to an end of the dust-proof pressure control component, and the other end of the pressure control spring is connected to a partition inside the hydrofracturing rod. The hydrofracturing rod below the dust-proof pressure control component is provided with a hydrofracturing passage which is perpendicular to an axial direction and communicates with an outside. The dust-proof pressure control component is further provided with a low-pressure water trough opening, and the low-pressure water trough opening is connected to an inside of a pressure rod on another side of the partition through a static water division passage. The hydrofracturing rod is connected to the drill bit through the end near the static water division passage. The anti-impact rod includes a rod body having an inner cavity and a guard installed in the inner cavity. The guard includes a cylindrical guard plate, an inside of one end of the guard plate is connected by connecting plates, and a semi-closed static water passage is formed in a middle. A middle section of the inner cavity is composed of a guard plate moving space, a connecting plate moving space and a push ball moving space communicating with each other. An expansion space is superimposed with the guard plate moving space at one end of the inner cavity, a diameter of the expansion space is larger than the push ball moving space, and an expansion space is superimposed with the connecting plate moving space and the guard plate moving space at the other end of the inner cavity. A guard plate blocking inner wall and a connecting plate blocking wall are further arranged on a middle section of the end near the expansion space, and a distance between the two is identical to the length of the guard plate having the connecting plates. The anti-impact rod is connected to the hydrofracturing rod through the end near the connecting plate moving space. The hole sealing rod is a hollow rod, and the outer portion thereof is provided with a hole sealing capsule. The crawler drill rod feeder includes a pipe body and a high-pressure water injection pipe at one end of the pipe body and communicating with the inside of the pipe body, a pressure relief valve is arranged between the high-pressure water injection pipe and the pipe body, and a guard valve is further arranged inside the other end of the pipe body. The crawler drill rod feeder is connected to the high-pressure sealed drill rod through the end near the high-pressure water injection pipe.

A drilling and hydrofracturing method using the long-distance drilling and hydrofracturing integrated device in underground mine includes following operation steps.

Step1, installation and drilling. (1) Connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder. (2) Opening the guard valve and closing the pressure relief valve during drilling, and introducing static pressure water to the drill rod, where the water flows through a rod line system consisting of the high-pressure sealed drill rod, the hole sealing rod, the static water passage of the anti-impact rod and the static water division passage of the hydrofracturing rod, and reaches the drill bit to cool the drill bit.

Step 2, hydrofracturing. (1) First, closing the guard valve and the pressure relief valve. (2) Then, closing the guard mode of the anti-impact rod: putting the push ball in, and introducing low-pressure water such that the low-pressure water carrying the push ball enters the rod line system, where when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out through a space between the connecting plates. At the same time, withdrawing the guard plate from the hole sealing capsule to expose the hole sealing capsule. (3) Next, injecting high-pressure water through the high-pressure water injection pipe to reach the hole sealing capsule, where the high-pressure water is injected to the hole sealing capsule through a water inlet of the hole sealing capsule to stuff the hole sealing capsule. Maintaining a pressure when the pressure reaches a specified value, and performing hydrofracturing after the pressure is stable. (4) Continuing to inject the high-pressure water through the high-pressure water injection pipe to reach the hydrofracturing rod through the high-pressure sealed drill rod, the anti-impact rod and the hole sealing rod, where when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing.

Step3, multiple times of multi-point hydrofracturing. After the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation in step 2 when the withdrawal reaches next hydrofracturing point, and so on, thus completing the withdrawal and multi-point hydrofracturing through the crawler drill.

Step 4, Rod withdrawal. After the last hydrofracturing point is completed, withdrawing all the rods through the crawler drill for next drilling construction.

Compared with the prior art, the long-distance drilling and hydrofracturing integrated device and method in underground mine according to the present invention have the advantages that, first, the drill bit, a hydrofracturing rod, the anti-impact rod, the hole sealing rod, the high-pressure sealed drill rod and the crawler drill rod feeder are effectively combined into a whole, and the crawler drill is used for automatic operation to realize the processes of drilling, guarding, hydrofracturing and hole sealing, so that the process of withdrawing a drill rod and feeding the high-pressure sealed drill rod is reduced, the mechanization level and safety are improved, the work efficiency is improved, the workers are reduced, the operation is simplified, and long-distance and large-angle drilling and hydrofracturing can be completed. At the same time, due to the combination of the anti-impact rod, the hole sealing rod and the hydrofracturing rod, the wear of drilling cuttings on a hole sealing structure is reduced, and the service life thereof is prolonged. Second, the integrated "drill rod" composed of the drill bit, the hydrofracturing rod, the anti-impact rod, the hole sealing rod and the high-pressure sealed drill rod solves the problems of wear of a hole sealer due to the rotation of a drill rod and tightness of an ordinary drill rod through high-pressure water in the underground mine hydraulic fracturing integrated technology, and is a new technology that really integrates the crawler drill with hydraulic fracturing.

BRIEF DESCRIPTION OF THE DRAWINGS

The following further illustrates the present invention with reference to the accompanying drawings and embodiments.

DESCRIPTION OF THE EMBODIMENTS

To make the objectives, technical solutions and advantages of the present invention clearer, the following clearly and completely describes the technical solutions in the embodiments of the present invention with reference to the accompanying drawings in the embodiments of the present invention. Apparently, the described embodiments are only part of the embodiments of the present invention, not all of the embodiments. All other embodiments obtained by those of ordinary skill in the art based on the embodiments of the present invention without any creative effort shall fall within the protection scope of the present invention.

Figure 1:
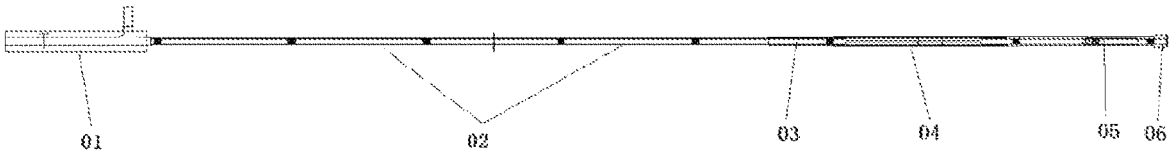
FIG. 1 is a structure perspective according to an embodiment of the present invention, where only threaded connectors are shown with cross sections.
Figure 2:
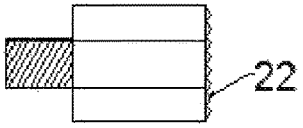
FIG. 2 is a structure perspective of a drill bit according to an embodiment of the present invention, where only threaded connectors are shown with cross sections.

FIG. 1 to FIG. 15 are structure diagrams according to a preferred embodiment of the present invention. In FIG. 1, a long-distance drilling and hydrofracturing integrated device in underground mine includes a drill bit 06, a hydrofracturing rod 05, an anti-impact rod 04, a hole sealing rod 03, a high-pressure sealed drill rod 02 and a crawler drill rod feeder 01 sequentially connected end to end. The drill bit 06, the hydrofracturing rod 05, the anti-impact rod 04, the hole sealing rod 03, the high-pressure sealed drill rod 02 and the crawler drill rod feeder 01 integrally connected form a new "drill rod", and ultimately realize automatic control through a crawler drill to complete the process of drilling, hydrofracturing, and sealing. The drill bit 06, the anti-impact rod 04, the hydrofracturing rod 05, the hole sealing rod 03, the high-pressure sealed drill rod 02 and the crawler drill rod feeder 01 may be connected to each other by screws, internal threads and sealing rings. The installation of the sealing rings is as shown in FIG. 12, threaded connectors or in-rod connecting threads are arranged at the ends of the drill bit 06 and the crawler drill rod feeder 01, threaded connectors and in-rod connecting threads are correspondingly arranged at two ends of the anti-impact rod 04, the hydrofracturing rod 05, the hole sealing rod 03 and the high-pressure sealed drill rod 02, the threaded connectors match with the in-rod connecting threads, and the in-rod connecting threads match with connecting rods and are sealed by the sealing rings in the middle. For example, specifically, a threaded connector 11 and an in-rod connecting thread 12 are respectively arranged at two ends of the anti-impact rod 04 (as shown in FIG. 4), correspondingly, the drill bit 06 has a threaded connector, a working end of the drill bit 06 has cutting teeth 22 (see FIG. 2) as components for cutting coal or rock, a threaded connector and an in-rod connecting thread are also respectively arranged at two ends of the hydrofracturing rod 05, the hole sealing rod 03 and the high-pressure sealed drill rod 02, and the crawler drill rod feeder 01 has a drill rod connector 27 (see FIG. 3) as a component for connecting the crawler drill with the drill rod. It may also be seen from FIG. 1 that the high-pressure sealed drill rod 02 is composed of multiple drill rod sections connected end to end, and a drill rod sealing ring 28 may also be installed at a joint of two adjacent drill rod sections.

Figure 15:
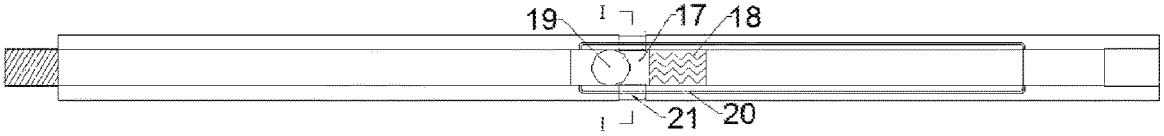
FIG. 15 is a structure perspective of a hydrofracturing rod according to an embodiment of the present invention, where only threaded connectors are shown with cross sections.
Figure 16:
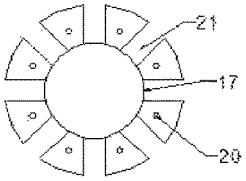
FIG. 16 is a cross-sectional view taken along line I-I of FIG. 14.

As shown in FIG. 15 and FIG. 16, the hydrofracturing rod 05 is hollow, a pressure control hydrofracturing device is installed at an inner middle position of the hydrofracturing rod 05, and the pressure control hydrofracturing device consists of a dust-proof pressure control component 17, a pressure control steel ball 19 and a pressure control spring 18, where the dust-proof pressure control component 17 is used to prevent dust from entering a hydrofracturing space so as to reduce wear of pressure control hydrofracturing device and prolong the service life, and also to prevent dust from entering the drill rod to block the drill rod. The pressure control steel ball 19 is installed in the dust-proof pressure control component 17. One end of the pressure control spring 18 is connected to an end of the dust-proof pressure control component 17, and the other end of the pressure control spring 18 is connected to a partition inside the hydrofracturing rod 05. The hydrofracturing rod 05 below the dust-proof pressure control component 17 is provided with a hydrofracturing passage 21 which is perpendicular to an axial direction and communicates with an outside, where the hydrofracturing passage 21 is a passage from which high-pressure water flows out to reach a drilled inner wall for hydrofracturing. When the pressure reaches a certain level, the pressure control steel ball 19 is withdrawn backward, the pressure control spring 18 begins to contract, and the hydrofracturing passage 21 is opened for the high-pressure water to prevent the stress concentration of the high-pressure water and prolong the service life of the device. The dust-proof pressure control component 17 is further provided with a low-pressure water trough opening. The low-pressure water trough opening is connected to an inside of a pressure rod on the other side of the partition through a static water division passage 20. Water flows smoothly when the pressure is low, and the pressure control spring 18 compresses the low-pressure water trough opening to close when the pressure increases. The hydrofracturing rod 05 is connected to the drill bit 06 through an end thereof near the static water division passage 20, and over-static pressure water reaches the drill bit 06 through the static water division passage 20 to cool the drill bit 06.

Referring to FIG. 4 to FIG. 10, the anti-impact rod 04 includes a rod body having an inner cavity and a guard installed in the inner cavity, where the inner cavity may be formed by an anti-impact rod outer wall 1 and an anti-impact rod inner wall 2. The guard includes a cylindrical guard plate 3-1. An inside of one end of the guard plate 3-1 is connected by connecting plates 3-2, and a semi-closed static water passage 4 is formed in a middle of the guard plate 3-1. During drilling, because static pressure water needs to be delivered to the drill bit 06 to cool the drill bit 06, this passage can allow the static water to flow through. A middle section of the inner cavity is composed of a guard plate moving space 13. A connecting plate moving space 14 and a push ball moving space 8 communicating with each other. An expansion space 29 is superimposed with the guard plate moving space 13 at one end of the inner cavity, a diameter of the expansion space 29 is larger than that of the push ball moving space 8, and an expansion space 29 is superimposed with the connecting plate moving space 14 and the guard plate moving space 13 at the other end of the inner cavity. Correspondingly, one end of the guard having the connecting plates 3-2 is installed at the end of the inner cavity where the expansion space 29 is superimposed with the connecting plate moving space 14 and the guard plate moving space 13. A guard plate blocking inner wall 9 and a connecting plate blocking wall 10 are further arranged on a middle section of an end of the inner cavity near the expansion space 29. A distance between the guard plate blocking inner wall 9 and the connecting plate blocking wall 10 is identical to a length of the guard plate having the connecting plates 3-2. The guard plate blocking inner wall 9 is an inner wall of a guard plate storage space for blocking the guard plate from moving down (the drilling direction), and the connecting plate blocking wall 10 is an inner wall of the connecting plate moving space 14 for blocking the connecting plates 3-2 from moving down (the drilling direction). A section of the guard plate moving space 13 within the guard plate blocking inner wall 9 is referred to as a guard plate storage inner wall 5 as an inner wall of a storage space of the guard plate 3-1 during hydrofracturing. The connecting plate moving space 14 is a space passage on which the connecting plates 3-2 move. The anti-impact rod 04 is connected to the hydrofracturing rod 05 through the end near the connecting plate moving space 14. Preferably, the push ball moving space 8 at the middle section of the inner cavity of the anti-impact rod 04 is in communication with the expansion spaces 29 at the two ends through transition slopes respectively, and when the high-pressure water flows through, the transition slopes prevent stress concentration therein. Specifically, a length of the guard is identical to a working length of the rod body except the two ends for connecting; and further preferably, four connecting plates 3-2 are used, and are uniformly distributed in the middle of the anti-impact rod 04 and connected to form a static water passage 4 extending outward to connect the guard plate 3-1.

In FIG. 4, the push ball 6 is not used during drilling. When the drilling is completed and the high-pressure water needs to be injected, the push ball 6 is added to the system and moves deep to the drill rod under the action of low-pressure water. When the push ball 6 arrives at the anti-impact rod 04, the push ball 6 blocks the static water passage 4 due to the blockage of the static water passage 4, so that the push ball 6 pushes the connecting plates 3-2 to move inward (the drilling direction). The push ball moving space 8 is a passage on which the push ball 6 moves within the anti-impact rod 04.

Figure 11:
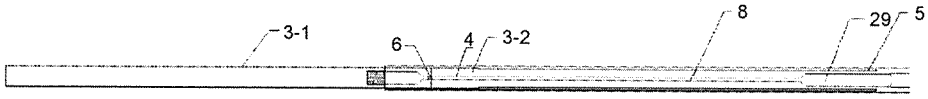
FIG. 11 is a structure perspective of the anti-impact rod in a guard mode, where only threaded connectors are shown with cross sections.
Figure 12:
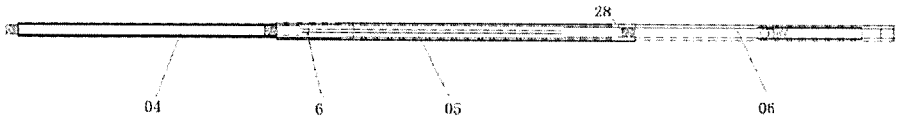
FIG. 12 is a structure diagram of a connection mode of the anti-impact rod in FIG. 4 in the guard mode.
Figure 13:
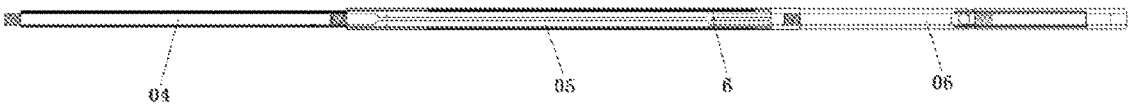
FIG. 13 is a structure diagram of a connection mode of the anti-impact rod in FIG. 4 in a hydrofracturing mode.

As shown in FIG. 11, when the guard inside the anti-impact rod 04 moves to the guard plate blocking inner wall 9 and the connecting plate blocking wall 10, the anti-impact rod 04 is in a guard mode. The anti-impact rod 04 in the guard mode can prevent the disadvantages that a hole sealing capsule 15 is worn and the service life of the hole sealing capsule 15 is shortened due to the contact between the discharged drilling cuttings and the hole sealing capsule 15 during drilling.

Figure 14:
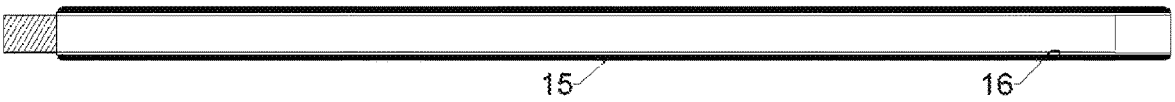
FIG. 14 is a structure perspective of a hole sealing rod according to an embodiment of the present invention, where only threaded connectors are shown with cross sections.

As shown in FIG. 14, the hole sealing rod 03 is a hollow rod, and the outer portion thereof is provided with a hole sealing capsule 15. The high-pressure water may be injected into the hole sealing capsule 15 through a water inlet of the hole sealing capsule 15 to stuff the hole sealing capsule 15 to a drilled inner wall, thus preventing the high-pressure water from rebounding the drill rod during hydrofracturing, where the water inlet of the hole sealing capsule 15 is used as an inlet through which the high-pressure water enters the hole sealing capsule 15.

Figure 3:
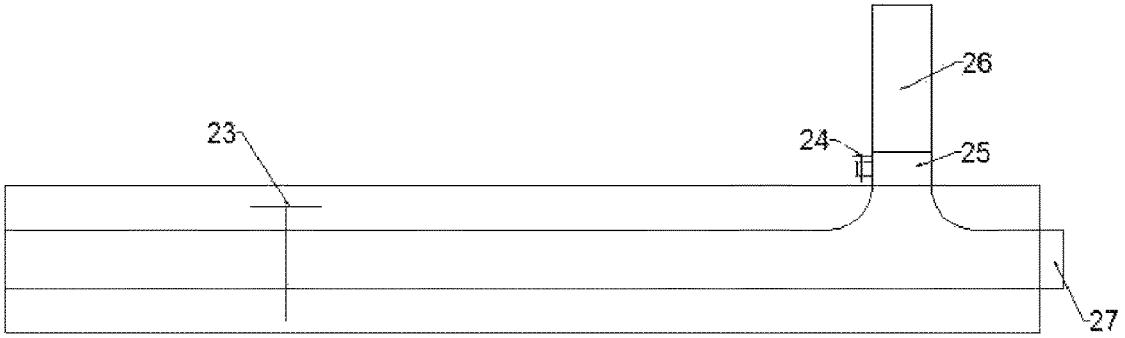
FIG. 3 is a structure perspective of a crawler drill rod feeder according to an embodiment of the present invention.
Figure 4:
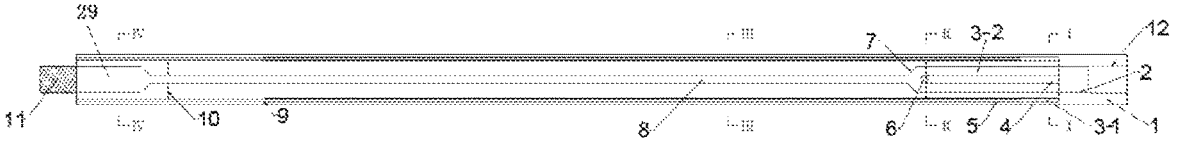
FIG. 4 is a structure perspective of an anti-impact rod according to an embodiment of the present invention, where only threaded connectors are shown with cross sections.
Figure 5:
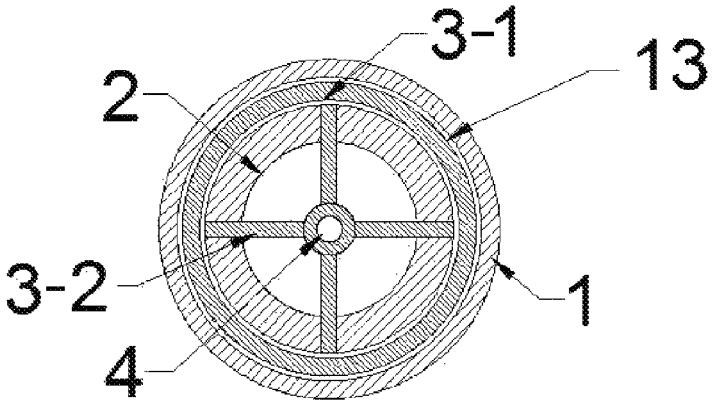
FIG. 5 is a cross-sectional view taken along line I-I of FIG. 4.
Figure 6:
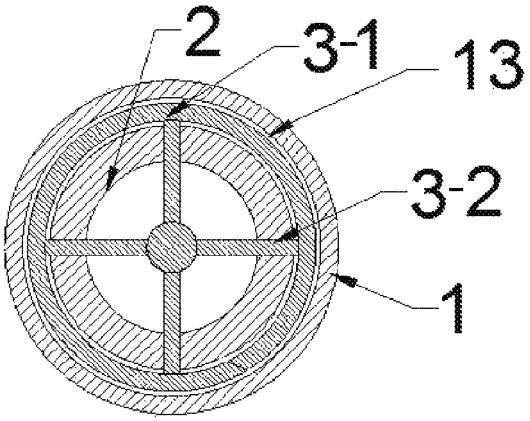
FIG. 6 is a cross-sectional view taken along line II-II of FIG. 4.
Figure 7:
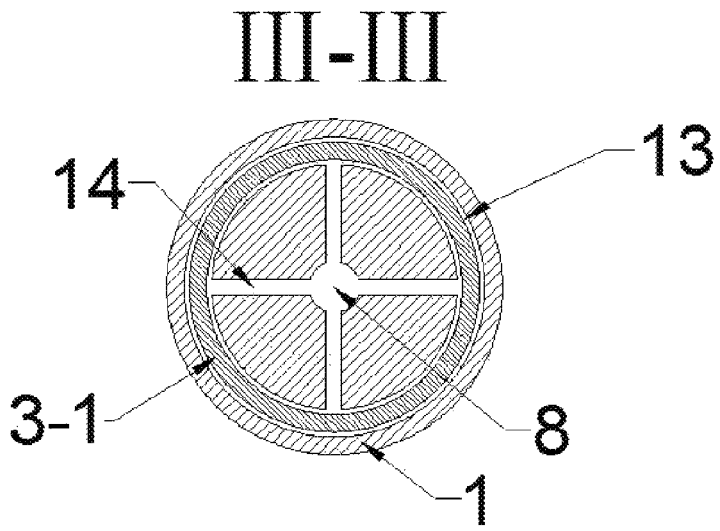
FIG. 7 is a cross-sectional view taken along line III-Ill of FIG. 4.
Figure 8:
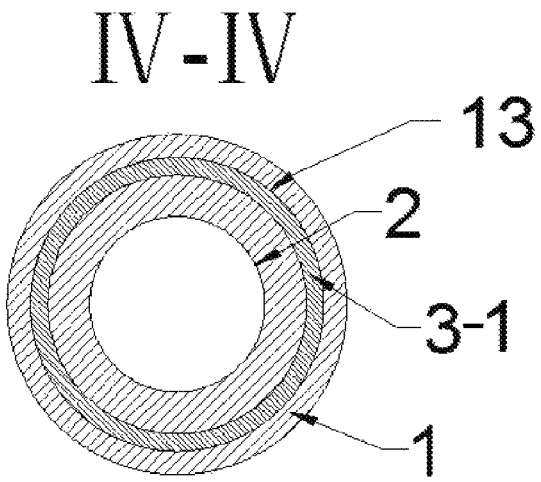
FIG. 8 is a cross-sectional view taken along line IV-IV of FIG. 4.
Figure 9:
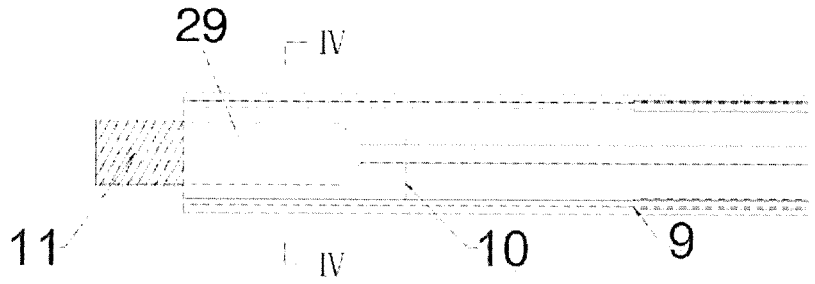
FIG. 9 and FIG. 10 are respectively partial enlarged views of two end portions of FIG. 4.
Figure 10:
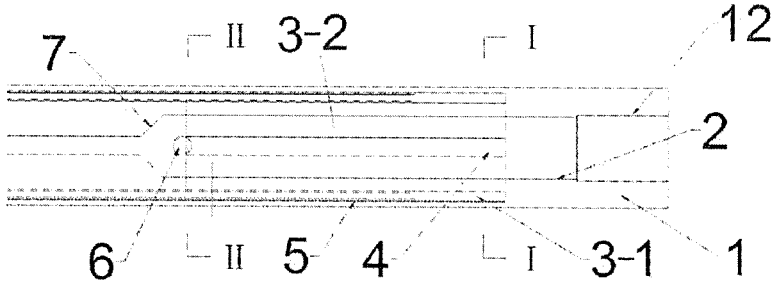

Referring to FIG. 3, the crawler drill rod feeder 01 includes a pipe body and a high-pressure water injection pipe 26 at one end of the pipe body and communicating with the inside of the pipe body. A pressure relief valve 24 is arranged between the high-pressure water injection pipe 26 and the pipe body, and a guard valve 23 is further arranged inside the other end of the pipe body. The crawler drill rod feeder 01 is connected to the high-pressure sealed drill rod 02 through the end near the high-pressure water injection pipe 26. The high-pressure water injection pipe 26 is a pipe for injecting the high-pressure water. The guard valve 23 is used to prevent the pressure of the high-pressure water from being too high. The pressure relief valve 24 is a valve for assisting in pressure relief on the high-pressure water inside the device after the hydrofracturing is completed. A high-pressure water injection pipe connector 25 may also be provided as a connector for connecting the high-pressure water injection pipe 26.

The construction process is as follows.

Step 1. Installation. The drill bit 06, the hydrofracturing rod 05, the anti-impact rod 04, the hole sealing rod 03 and the high-pressure sealed drill rod 02 are sequentially connected as shown in FIG. 1, the anti-impact rod 04 is in a guard mode (see FIGS. 11 and 12) during installation, and all the rods are connected to the previous rods by connectors and sealing rings. Finally, a tail of the drill rod is connected to the crawler drill. During drilling, the guard valve 23 is opened, the pressure relief valve 24 is closed, static pressure water is introduced to the drill rod, and the water flows through the high-pressure sealed drill rod 02, the hole sealing rod 03, the static water passage 4 of the anti-impact rod 04 and the static water division passage 20 of the hydrofracturing rod 05, and reaches the drill bit 06 to cool the drill bit 06 (the water flows through the anti-impact rod 04 via the static water passage 4, and reaches the drill bit 06 via the static water division passage 20 in the hydrofracturing rod 05). During installation, the push ball 6 is not added, and the drill rods are automatically installed by the crawler drill.

Step 2. Hydrofracturing. (1) The guard valve 23 and the pressure relief valve 24 are closed. The guard valve 23 is closed to prevent the high-pressure water from entering the inside of the drill to damage the drill, the pressure relief valve is closed to prevent water loss and reduce the displacement of required water, and the high-pressure water flows out from the pressure relief valve, which not only reduces the working efficiency and increases the working time, and but also may cause the discharged the high-pressure water to damage the surrounding. (2) The guard mode of the anti-impact rod 04 is closed. The push ball 6 is put in, low-pressure water is introduced first, and the low-pressure water carrying the push ball 6 enters the rod line system. When the push ball 6 reaches the static water passage 4, the guard plate 3-1 carrying the connecting plates 3-2 is pushed to move toward the inside of the anti-impact rod 04 till reaching the bottom of the guard plate storage space, the low-pressure water flows out through the space between the connecting plates 3-2, and at the same time, the guard plate 3-1 is withdrawn from the hole sealing capsule 15 to expose the hole sealing capsule 15 (a method for determining that the push ball 6 is pushed to the bottom is as follows. When the ball contacts the static water passage 4, the water pressure increases and continues for a while. When the push ball 6 is pushed to the bottom, the water pressure decreases. Therefore, it is only necessary to put a pressure sensor or a pressure gauge on the static water injection port to observe the pressure change). (3) The high-pressure water injection pipe 26 is connected with the high-pressure water injection pipe connector 25. (4) The high-pressure water is injected through the high-pressure water injection pipe 26, and the high-pressure water reaches the hole sealing capsule 15, where the high-pressure water is injected into the hole sealing capsule 15 through the hole sealing capsule water inlet 16 to stuff the hole sealing capsule 15. When the pressure reaches a specified value, the pressure is maintained. When the pressure is stable, hydrofracturing is performed. (5) The high-pressure water is continuously injected through the high-pressure water injection pipe 26, and the high-pressure water flows through the high-pressure sealed drill rod 02, the anti-impact rod 04 and the hole sealing rod 03, and reaches the hydrofracturing rod 05. When the water pressure reaches a certain value, the pressure control steel ball 19 and the dust-proof pressure control component transmit force to the pressure control spring 18 to compress the spring, and the high-pressure water flows out from eight directions to fracture a coal (rock) wall, thus completing the hydrofracturing.

Step 3. Multiple times of multi-point hydrofracturing. After the previous hydrofracturing point is completed, pressure relief is performed on the hole sealing capsule 15 (injection of the high-pressure water is stopped, and the pressure relief valve 24 is opened to relieve pressure). When a little water flows out from the pressure relief valve, after the pressure relief is completed, the rods are automatically withdrawn by the crawler drill. When the drill rod is withdrawn to next hydrofracturing point, (4) and (5) of the hydrofracturing operation in step 2 are repeated. In this way, the withdrawal and multi-point hydrofracturing may be completed by the drill. The process is implemented by the crawler drill, thereby reducing the manpower and improving the working efficiency.

Step 4. Rod withdrawal. After the last hydrofracturing point is completed, all the rods are withdrawn through the crawler drill for next drilling construction.

The advantages of the present invention are as follows.

1. The crawler drill is used instead of manpower for feeding rods for drilling, thus improving the propulsive force, completing the tasks that cannot be completed by manpower such as long distance and large angle, reducing workers, improving the level of mechanization, and improving the working efficiency.

2. The integration of drilling and hole sealing reduces the intermediate link. The drill rod for drilling is designed as a hollow water-permeable large-diameter drill rod, the anti-impact rod 04 and the hydrofracturing rod 05 are designed, the anti-impact rod 04, the hole sealing rod 03 and the drill bit 06 are connected, and the joints are sealed with sealing rings.

3. With the use of the drilling and hydrofracturing integrated device and method in underground mine, the drill rod, the hydrofracturing rod 05 and the like are delivered to the designated position while drilling, so that the drill rod does not need to be taken out, only the crawler drill needs to be improved, high-pressure water holes are added to the rod feeder, and the high-pressure water enters the drill rod from the high-pressure water holes and reaches the hydrofracturing portion. When the hydrofracturing is completed, the drill rod is withdrawn by the crawler drill, the hydrofracturing hole reaches another hydrofracturing point, and high-pressure water is injected again for hydrofracturing. This method reduces two links of withdrawing the drill rod and installing the hole sealer in the mid-way, so that the operation is simplified. The safety is improved in the presence of the crawler drill.

4. The drill rod of this system consists of a high-pressure sealed drill rod, a hydrofracturing bar 05, an anti-impact rod 04 and a hole sealing rod 03 with large torsional strength. The anti-impact rod 04 is connected with the hole sealing rod 03, and the guard plate 3-1 of the anti-impact rod 04 is unfolded and sleeved on the hole sealing rod 03 to seal a hole sealer, thus preventing drilling cuttings from being in contact with the hole sealing capsule 15 to wear the hole sealing capsule 15 and shorten the service life thereof.

5. The internal connector used in the hole sealing capsule presents wear, short use time and short service life of the hole sealing capsule 15 due to the rotation of a high-pressure thin hose driven by the rotation of the drill rod outside where pipes are located.

6. In the device and the method, high-pressure water is injected from the inside of the drill rod, thereby reducing the wear of a high-pressure thin hose conventionally used from the outside and the operation difficulty in withdrawing rods, accelerating rod withdrawal, reducing the rod withdrawal time, and improving the work efficiency.

In the present invention, the cooling water rotary connector of the crawler drill is changed into a high-pressure rotary connector (one end of the high-pressure rotary connector is connected with a water pipe, and the other end is connected with the drill rod). After the drilling is completed, the cooling water pipe is removed and replaced with a hydraulic fracturing high-pressure water pipe. The ordinary drill rod is replaced with the high-pressure sealed drill rod 02, which can withstand high-pressure water and transfer the torque of the drill. The drill bit 06 is at the front end of the high-pressure sealed drill rod 02, and the hole sealer is behind the drill bit 06, so that the drilling, the withdrawal of the drill rod and the installation of the hole sealer are combined and completed in one step to reduce the working time, improve the working efficiency and improve the level of mechanization. At the same time, the high-power crawler drill can complete long-distance and large-angle drilling and hydrofracturing.

Described above are only preferred embodiments of the present invention, and the present invention is not limited thereto in any form. Any simple modifications and equivalent changes made to the above embodiments according to the technical essence of the present invention fall within the scope of the present invention.

What is claimed is:

1. A long-distance drilling and hydrofracturing integrated device in underground mine, the device comprising a drill bit, a hydrofracturing rod, an anti-impact rod, a hole sealing rod, a high-pressure sealed drill rod and a crawler drill rod feeder sequentially connected end to end; wherein the hydrofracturing rod is hollow, a pressure control hydrofracturing device is installed at an inner middle position of the hydrofracturing rod, and the pressure control hydrofracturing device consists of a dust-proof pressure control component, a pressure control steel ball and a pressure control spring, wherein the pressure control steel ball is installed in the dust-proof pressure control component, one end of the pressure control spring is connected to an end of the dust-proof pressure control component, the other end of the pressure control spring is connected to a partition inside the hydrofracturing rod, the hydrofracturing rod is provided with a hydrofracturing passage which is radially outward from the dust-proof pressure control component and perpendicular to an axial direction and communicates with an outside of the hydrofracturing rod, the dust-proof pressure control component is further provided with a low-pressure water trough opening, and the low-pressure water trough opening is connected to an inside of a portion of the hydrofracturing rod on another side of the partition through a static water division passage;

the hydrofracturing rod is connected to the drill bit through an end near the static water division passage;

the anti-impact rod comprises a rod body having an inner cavity and a guard installed in the inner cavity, wherein the guard comprises a cylindrical guard plate, an inside of one end of the guard plate is connected by connecting plates, and a semi-closed static water passage is formed in a middle of the guard plate; a middle section of the inner cavity is composed of a guard plate moving space, a connecting plate moving space and a push ball moving space communicating with each other, a first expansion space is superimposed with the guard plate moving space at one end of the inner cavity, a diameter of the first expansion space is larger than that of the push ball moving space, and a second expansion space is superimposed with the connecting plate moving space and the guard plate moving space at the other end of the inner cavity; a guard plate blocking inner wall and a connecting plate blocking wall are further arranged on a middle section of an end near the first expansion space, and a distance between the guard plate blocking inner wall and the connecting plate blocking wall is identical to a length of the guard plate having the connecting plates;

the anti-impact rod is connected to the hydrofracturing rod through an end near the connecting plate moving space;

the hole sealing rod is a hollow rod, and an outer portion thereof is provided with a hole sealing capsule;

the crawler drill rod feeder comprises a pipe body and a high-pressure water injection pipe at one end of the pipe body and communicating with an inside of the pipe body, a pressure relief valve is arranged between the high-pressure water injection pipe and the pipe body, and a guard valve is further arranged inside the other end of the pipe body; and the crawler drill rod feeder is connected to the high-pressure sealed drill rod through an end near the high-pressure water injection pipe.

2. The long-distance drilling and hydrofracturing integrated device in underground mine according to claim 1, wherein the drill bit, the anti-impact rod, the hydrofracturing rod, the hole sealing rod, the high-pressure sealed drill rod and the crawler drill rod feeder are connected to each other threaded connectors or in-rod connecting threads are arranged at an end portion of the drill bit and an end portion of the crawler drill rod feeder, and threaded connectors and in-rod connecting threads are correspondingly and respectively arranged at two ends of the anti-impact rod, two ends of the hydrofracturing rod, two ends of the hole sealing rod and two ends of the high-pressure sealed drill rod.

3. The long-distance drilling and hydrofracturing integrated device in underground mine according to claim 1, wherein the push ball moving space at the middle section of the inner cavity of the anti-impact rod is in communication with the first and second expansion spaces at two ends of the anti-impact rod through transition slopes respectively.

4. The long-distance drilling and hydrofracturing integrated device in underground mine according to claim 1, wherein a length of the guard is identical to a working length of the rod body excluding a length of two ends of the rod body for connection.

5. The long-distance drilling and hydrofracturing integrated device in underground mine according to claim 1, wherein four connecting plates are used, the four connecting plates are uniformly distributed in a middle of the anti-impact rod and connected to form the static water passage, and the four connecting plates extend outward to connect the guard plate.

6. The long-distance drilling and hydrofracturing integrated device in underground mine according to claim 1, wherein the high-pressure sealed drill rod is composed of multiple drill rod sections connected end to end, and a sealing ring is installed at a joint of adjacent two of the drill rod sections.

7. A drilling and hydrofracturing method using the long-distance drilling and hydrofracturing integrated device in underground mine according to claim 1, the method comprising following operation steps:

step 1, installation and drilling:

(1) connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder; and (2) opening the guard valve and closing the pressure relief valve during drilling, and introducing static pressure water to the drill rod, wherein the water flows through a rod line system consisting of the high-pressure sealed drill rod, the hole sealing rod, the static water passage of the anti-impact rod and the static water division passage of the hydrofracturing rod, and reaches the drill bit to cool the drill bit;

step 2, hydrofracturing:

(1) first, closing the guard valve and the pressure relief valve;

(2) then, closing the guard mode of the anti-impact rod: putting the push ball in, and introducing low-pressure water such that the low-pressure water carrying the push ball enters the rod line system, wherein when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out though a space between the connecting plates; at the same time, withdrawing the guard plate from the hole sealing capsule to expose the hole sealing capsule;

(3) next, injecting high-pressure water through the high-pressure water injection pipe to reach the hole sealing capsule, wherein the high-pressure water is injected to the hole sealing capsule through a water inlet of the hole sealing capsule to stuff the hole sealing capsule; maintaining a pressure when the pressure reaches a specified value, and performing hydrofracturing after the pressure is stable; and (4) continuing to inject the high-pressure water through the high-pressure water injection pipe to reach the hydrofracturing rod through the high-pressure sealed drill rod, the anti-impact rod and the hole sealing rod, wherein when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing;

step 3, multiple times of multi-point hydrofracturing: after the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation in step 2 when the withdrawal reaches next hydrofracturing point, and so on, thus completing the withdrawal and multi-point hydrofracturing through the crawler drill; and step 4, rod withdrawal: after the last hydrofracturing point is completed, withdrawing all the rods through the crawler drill for next drilling construction.

8. A drilling and hydrofracturing method using the long-distance drilling and hydrofracturing integrated device in underground mine according to claim 2, the method comprising following operation steps:

step 1, installation and drilling:

(1) connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder; and (2) opening the guard valve and closing the pressure relief valve during drilling, and introducing static pressure water to the drill rod, wherein the water flows through a rod line system consisting of the high-pressure sealed drill rod, the hole sealing rod, the static water passage of the anti-impact rod and the static water division passage of the hydrofracturing rod, and reaches the drill bit to cool the drill bit;

step 2, hydrofracturing:

(1) first, closing the guard valve and the pressure relief valve;

(2) then, closing the guard mode of the anti-impact rod: putting the push ball in, and introducing low-pressure water such that the low-pressure water carrying the push ball enters the rod line system, wherein when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out through a space between the connecting plates; at the same time, withdrawing the guard plate from the hole sealing capsule to expose the hole sealing capsule;

(3) next, injecting high-pressure water through the high-pressure water injection pipe to reach the hole sealing capsule, wherein the high-pressure water is injected to the hole sealing capsule through a water inlet of the hole sealing capsule to stuff the hole sealing capsule; maintaining a pressure when the pressure reaches a specified value, and performing hydrofracturing after the pressure is stable; and (4) continuing to inject the high-pressure water through the high-pressure water injection pipe to reach the hydrofracturing rod through the high-pressure sealed drill rod, the anti-impact rod and the hole sealing rod, wherein when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing;

step 3, multiple times of multi-point hydrofracturing: after the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation_in step 2 when the withdrawal reaches next hydrofracturing point, and so on, thus completing the withdrawal and multi-point hydrofracturing through the crawler drill; and step 4, rod withdrawal: after the last hydrofracturing point is completed, withdrawing all the rods through the crawler drill for next drilling construction.

9. A drilling and hydrofracturing method using the long-distance drilling and hydrofracturing integrated device in underground mine according to claim 3, the method comprising following operation steps:

step 1, installation and drilling:

(1) connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder; and (2) opening the guard valve and closing the pressure relief valve during drilling, and introducing static pressure water to the drill rod, wherein the water flows through a rod line system consisting of the high-pressure sealed drill rod, the hole sealing rod, the static water passage of the anti-impact rod and the static water division passage of the hydrofracturing rod, and reaches the drill bit to cool the drill bit;

step 2, hydrofracturing:

(1) first, closing the guard valve and the pressure relief valve;

(2) then, closing the guard mode of the anti-impact rod: putting the push ball in, and introducing low-pressure water such that the low-pressure water carrying the push ball enters the rod line system, wherein when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out through a space between the connecting plates; at the same time, withdrawing the guard plate from the hole sealing capsule to expose the hole sealing capsule;

(3) next, injecting high-pressure water through the high-pressure water injection pipe to reach the hole sealing capsule, wherein the high-pressure water is injected to the hole sealing capsule through a water inlet of the hole sealing capsule to stuff the hole sealing capsule; maintaining a pressure when the pressure reaches a specified value, and performing hydrofracturing after the pressure is stable; and (4) continuing to inject the high-pressure water through the high-pressure water injection pipe to reach the hydro fracturing rod through the high-pressure sealed drill rod, the anti-impact rod and the hole sealing rod, wherein when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing;

step 3, multiple times of multi-point hydrofracturing: after the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation_in step 2 when the withdrawal reaches next hydrofracturing point, and so on, thus completing the withdrawal and multi-point hydrofracturing through the crawler drill; and step 4, rod withdrawal: after the last hydrofracturing point is completed, withdrawing all the rods through the crawler drill for next drilling construction.

10. A drilling and hydrofracturing method using the long-distance drilling and hydrofracturing integrated device in underground mine according to claim 4, the method comprising following operation steps:

step 1, installation and drilling:

(1) connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder; and (2) opening the guard valve and closing the pressure relief valve during drilling, and introducing static pressure water to the drill rod, wherein the water flows through a rod line system consisting of the high-pressure sealed drill rod, the hole sealing rod, the static water passage of the anti-impact rod and the static water division passage of the hydrofracturing rod, and reaches the drill bit to cool the drill bit;

step 2, hydrofracturing:

(1) first, closing the guard valve and the pressure relief valve;

(2) then, closing the guard mode of the anti-impact rod: putting the push ball in, and introducing low-pressure water such that the low-pressure water carrying the push ball enters the rod line system, wherein when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out through a space between the connecting plates; at the same time, withdrawing the guard plate from the hole sealing capsule to expose the hole sealing capsule;

(3) next, injecting high-pressure water through the high-pressure water injection pipe to reach the hole sealing capsule, wherein the high-pressure water is injected to the hole sealing capsule through a water inlet of the hole sealing capsule to stuff the hole sealing capsule; maintaining a pressure when the pressure reaches a specified value, and performing hydrofracturing after the pressure is stable; and (4) continuing to inject the high-pressure water through the high-pressure water injection pipe to reach the hydrofracturing rod through the high-pressure sealed drill rod, the anti-impact rod and the hole sealing rod, wherein when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing;

step 3, multiple times of multi-point hydrofracturing: after the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation_in step 2 when the withdrawal reaches next hydrofracturing point, and so on, thus completing the withdrawal and multi-point hydrofracturing through the crawler drill; and step 4, rod withdrawal: after the last hydrofracturing point is completed, withdrawing all the rods through the crawler drill for next drilling construction.

11. A drilling and hydrofracturing method using the long-distance drilling and hydrofracturing integrated device in underground mine according to claim 5, the method comprising following operation steps:

step 1, installation and drilling:

(1) connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder; and (2) opening the guard valve and closing the pressure relief valve during drilling, and introducing static pressure water to the drill rod, wherein the water flows through a rod line system consisting of the high-pressure sealed drill rod, the hole sealing rod, the static water passage of the anti-impact rod and the static water division passage of the hydrofracturing rod, and reaches the drill bit to cool the drill bit;

step 2, hydrofracturing:

(1) first, closing the guard valve and the pressure relief valve;

(2) then, closing the guard mode of the anti-impact rod: putting the push ball in, and introducing low-pressure water such that the low-pressure water carrying the push ball enters the rod line system, wherein when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out through a space between the connecting plates; at the same time, withdrawing the guard plate from the hole sealing capsule to expose the hole sealing capsule;

(3) next, injecting high-pressure water through the high-pressure water injection pipe to reach the hole sealing capsule, wherein the high-pressure water is injected to the hole sealing capsule through a water inlet of the hole sealing capsule to stuff the hole sealing capsule; maintaining a pressure when the pressure reaches a specified value, and performing hydrofracturing after the pressure is stable; and (4) continuing to inject the high-pressure water through the high-pressure water injection pipe to reach the hydrofracturing rod through the high-pressure sealed drill rod, the anti-impact rod and the hole sealing rod, wherein when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing;

step 3, multiple times of multi-point hydrofracturing: after the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation_in step 2 when the withdrawal reaches next hydrofracturing point, and so on, thus completing the withdrawal and multi-point hydrofracturing through the crawler drill; and step 4, rod withdrawal: after the last hydrofracturing point is completed, withdrawing all the rods through the crawler drill for next drilling construction.

12. A drilling and hydrofracturing method using the long-distance drilling and hydrofracturing integrated device in underground mine according to claim 6, the method comprising following operation steps:

step 1, installation and drilling:

(1) connecting and sealing the drill bit, the hydrofracturing rod, the anti-impact rod, the hole sealing rod and the high-pressure sealed drill rod in sequence, moving the guard inside the anti-impact rod to the guard plate blocking inner wall and the connecting plate blocking wall to be in a guard mode during installation of the anti-impact rod, and finally connecting a tail of the high-pressure sealed drill rod to the crawler drill rod feeder; and (2) opening the guard valve and closing the pressure relief valve during drilling, and introducing static pressure water to the drill rod, wherein the water flows through a rod line system consisting of the high-pressure sealed drill rod, the hole sealing rod, the static water passage of the anti-impact rod and the static water division passage of the hydrofracturing rod, and reaches the drill bit to cool the drill bit;

step 2, hydrofracturing:

(1) first, closing the guard valve and the pressure relief valve;

(2) then, closing the guard mode of the anti-impact rod: putting the push ball in, and introducing low-pressure water such that the low-pressure water carrying the push ball enters the rod line system, wherein when the push ball reaches an outside of a closed end of the static water passage, the guard plate carrying the connecting plates of the guard is pushed to move toward an inside of the anti-impact rod till reaching a bottommost portion of a guard plate storage space, and the low-pressure water flows out through a space between the connecting plates; at the same time, withdrawing the guard plate from the hole sealing capsule to expose the hole sealing capsule;

(3) next, injecting high-pressure water through the high-pressure water injection pipe to reach the hole sealing capsule, wherein the high-pressure water is injected to the hole sealing capsule through a water inlet of the hole sealing capsule to stuff the hole sealing capsule; maintaining a pressure when the pressure reaches a specified value, and performing hydrofracturing after the pressure is stable; and (4) continuing to inject the high-pressure water through the high-pressure water injection pipe to reach the hydrofracturing rod through the high-pressure sealed drill rod, the anti-impact rod and the hole sealing rod, wherein when the water pressure reaches a certain value, the pressure control steel ball and the dust-proof pressure control component transfer force to the pressure control spring, so that the pressure control spring is compressed, and the high-pressure water flows out from eight directions to fracture a coal wall or a rock wall, thus completing the hydrofracturing;

step 3, multiple times of multi-point hydrofracturing: after the previous hydrofracturing point is completed, stopping injecting the high-pressure water, opening the pressure relief valve to relieve pressure, completing the pressure relief on the hole sealing capsule when a little water flows out from the pressure relief valve, automatically withdrawing rods by a crawler drill, repeating (3) and (4) of the hydrofracturing operation_in step 2 when the withdrawal reaches next hydrofracturing point, and so on, thus completing the withdrawal and multi-point hydrofracturing through the crawler drill; and step 4, rod withdrawal: after the last hydrofracturing point is completed, withdrawing all the rods through the crawler drill for next drilling construction.

* * * * *